US011910897B2

(12) United States Patent
Libuda

(10) Patent No.: US 11,910,897 B2
(45) Date of Patent: Feb. 27, 2024

(54) LIGHTWEIGHT SUITCASE, IN PARTICULAR TRAVEL SUITCASE

(71) Applicant: Georg-Guenter Libuda, Villingen-Schwenningen (DE)

(72) Inventor: Georg-Guenter Libuda, Villingen-Schwenningen (DE)

( * ) Notice: Subject to any disclaimer, the term of this patent is extended or adjusted under 35 U.S.C. 154(b) by 601 days.

(21) Appl. No.: 16/979,446

(22) PCT Filed: Mar. 7, 2019

(86) PCT No.: PCT/DE2019/100207

§ 371 (c)(1),
(2) Date: Sep. 9, 2020

(87) PCT Pub. No.: WO2019/170199

PCT Pub. Date: Sep. 12, 2019

(65) Prior Publication Data

US 2021/0000230 A1 Jan. 7, 2021

(30) Foreign Application Priority Data

Mar. 9, 2018 (DE) ..... 20 2018 101 341.6
Mar. 9, 2018 (LU) ..... 100733

(51) Int. Cl.
*A45C 5/14* (2006.01)
*A45C 7/00* (2006.01)
*A47B 61/06* (2006.01)

(52) U.S. Cl.
CPC ..... *A45C 5/14* (2013.01); *A45C 7/0031* (2013.01); *A47B 61/06* (2013.01)

(58) Field of Classification Search
CPC ..... A45C 5/14; A45C 7/0031; A47B 61/06
See application file for complete search history.

(56) References Cited

U.S. PATENT DOCUMENTS 367,979 A * 8/1887 Hess ..... A45C 5/00 190/7
672,143 A * 4/1901 Boughner ..... A45C 7/0031 190/104

(Continued)

FOREIGN PATENT DOCUMENTS

CA 2936342 A1 * 1/2018
DE 20 2010 000 304 U1 8/2011

(Continued)

*Primary Examiner* — John K Fristoe, Jr.
*Assistant Examiner* — Justin Caudill
(74) *Attorney, Agent, or Firm* — Muncy, Geissler, Olds & Lowe, P.C.

(57) ABSTRACT

A lightweight case with a mobile wall cabinet having a base tray, a case lid in the form of a hood shell, with a base tray mounted on it, in particular rotatable through 360° perpendicular to the roller plane and plane of the base tray, wheels and telescopic rails with integrated locking as prefabricated components and a flexible, lightweight suitcase wall material which is formed between the floor trough and the hood shell, wherein the hood shell with the telescopic rails is designed to be lockable, translatorically retractable and extendable by means of a pushbutton integrated in the hood shell and an integrated pushbutton force distributor strut and with a supporting strut, the supporting strut fastening at least one, preferably two, telescopic rails to the suitcase wall material, so that the suitcase is formed with a stable spatial structure forming a wall cupboard, in particular also for the expanded state.

20 Claims, 13 Drawing Sheets

(56) References Cited

U.S. PATENT DOCUMENTS 4,312,431 A * 1/1982 Corey ..... A45C 7/0072 190/104
4,813,521 A * 3/1989 Goldstone ..... A45C 7/00 190/18 A
D313,928 S * 1/1991 Orii ..... D8/375
5,307,908 A * 5/1994 Shyr ..... A45C 5/14 190/111
6,595,604 B1 * 7/2003 Peterson ..... A45C 13/02 190/110
7,232,018 B1 * 6/2007 Salander ..... A45C 5/14 280/37
D625,517 S * 10/2010 Rossi ..... D3/291
D640,468 S * 6/2011 Libuda ..... D3/274
D644,057 S * 8/2011 Nielsen ..... D6/629
D666,816 S * 9/2012 Weber ..... D3/279
D830,694 S * 10/2018 Barker ..... D3/285
2003/0019705 A1 * 1/2003 Lau ..... B60B 33/0057 190/18 A
2005/0098403 A1 * 5/2005 McIntyre ..... A45C 5/04 190/110
2005/0121275 A1 * 6/2005 Platte, III ..... A45C 5/14 190/110
2005/0126872 A1 * 6/2005 Dror ..... A45C 9/00 190/110
2005/0268622 A1 * 12/2005 Krieger ..... A45C 5/14 62/3.6
2006/0000681 A1 1/2006 Barker et al.
2006/0180422 A1 * 8/2006 Lin ..... A45C 5/14 190/18 R
2007/0295570 A1 * 12/2007 Campbell ..... A45C 13/262 190/15 R
2008/0083592 A1 * 4/2008 Mangano ..... A45C 7/0077 190/110
2008/0217193 A1 * 9/2008 Amin ..... A63B 55/30 220/756
2008/0308371 A1 * 12/2008 Yang ..... A45C 13/02 190/110
2010/0117499 A1 * 5/2010 Fortier ..... A45C 7/0031 312/306
2011/0042398 A1 * 2/2011 Vanderberg ..... F25D 3/06 220/666
2011/0168508 A1 * 7/2011 Jiang ..... A45C 5/14 190/18 A
2012/0145592 A1 * 6/2012 Libuda ..... A45C 13/26 206/736
2014/0216875 A1 * 8/2014 Cavalheiro ..... A47B 61/06 190/15 R
2015/0144447 A1 * 5/2015 Mandel ..... A45C 7/0031 190/105
2015/0327639 A1 * 11/2015 Antonelli ..... A45C 7/0022 190/18 A
2015/0335176 A1 * 11/2015 Piskor ..... A47F 5/108 211/187
2016/0150862 A1 * 6/2016 Tonelli ..... A45C 13/262 190/115
2016/0249721 A1 * 9/2016 Yazdi ..... A45C 13/02 190/18 A
2017/0208935 A1 * 7/2017 Vallo ..... A47B 95/02

FOREIGN PATENT DOCUMENTS

KR 20120085820 A * 10/2010 ..... A45C 5/14
WO WO 2008/026188 A2 3/2008
WO WO-2010122259 A1 * 10/2010 ..... A45C 13/04
WO WO-2016053387 A1 * 4/2016 ..... A45C 13/36

* cited by examiner

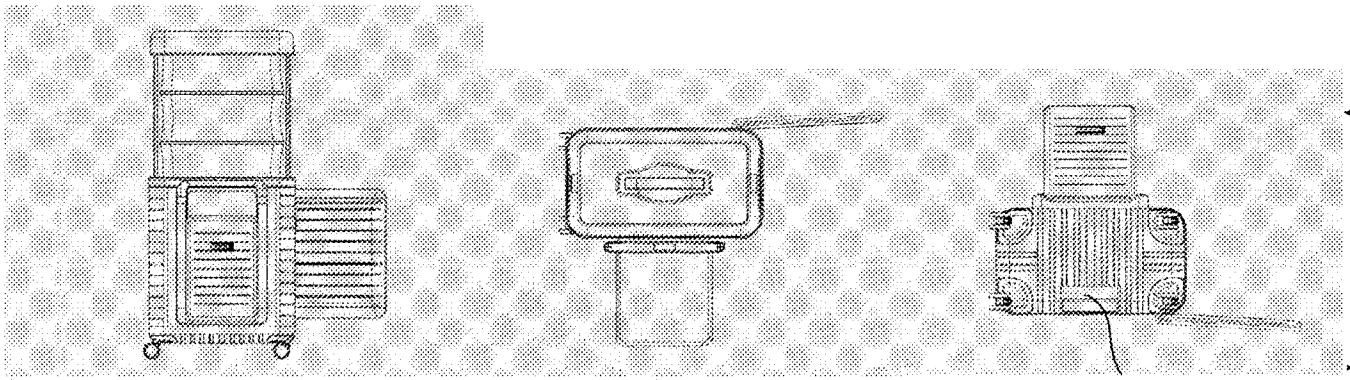
Fig.25
Fig.26
Fig.27
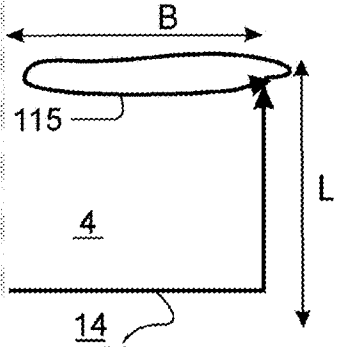
Fig.32
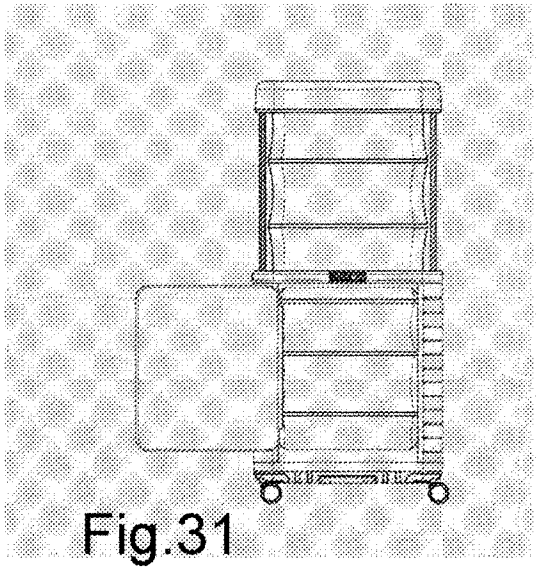
Fig.31
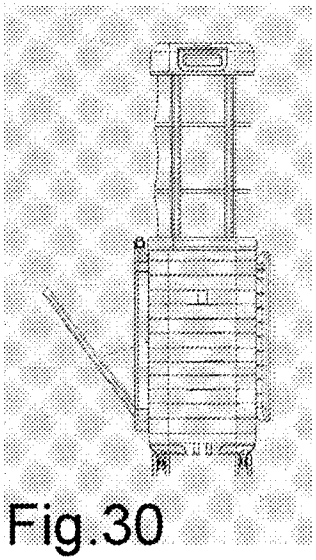
Fig.30
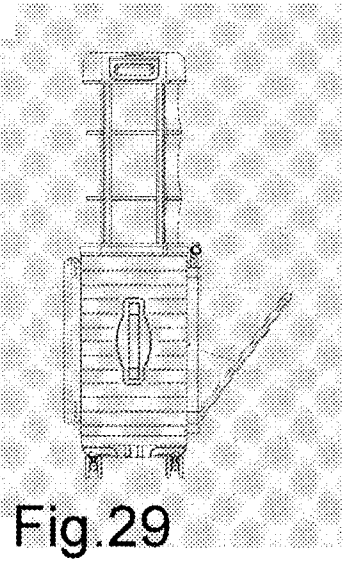
Fig.29
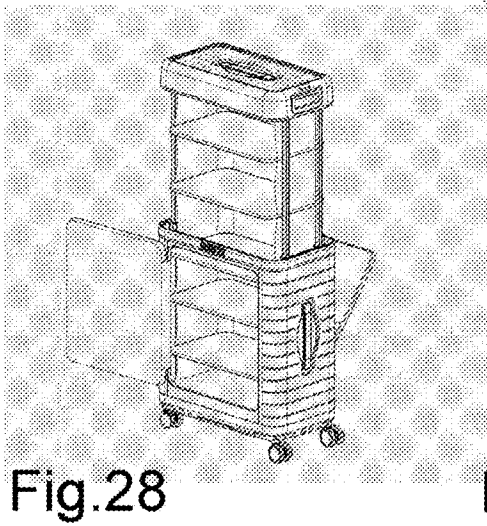
Fig.28

LIGHTWEIGHT SUITCASE, IN PARTICULAR TRAVEL SUITCASE

This nonprovisional application is a National Stage of International Application No. PCT/DE2019/100207, which was filed on Mar. 7, 2019, and which claims priority to German Patent Application No. 20 2018 101 341.6, which was filed in Germany on Mar. 9, 2018 and also claims priority to Luxembourg Application No. 100733, which was filed in Luxembourg on Mar. 9, 2018, and which are all herein incorporated by reference.

BACKGROUND OF THE INVENTION

Field of the Invention

A lightweight suitcase, in particular a travel suitcase, a manufacturing process and a handling process for it are described herein.

Description of the Background Art

Modern, lightweight travel suitcases comprise two shell halves extending over the length and width of the suitcase. The shell halves are often connected via the front with a closing device along the length and width of the case, often a zipper, or with an interlocking tongue and groove shell closure with lockable buckle closures. These suitcases are usually configured with a hinge to rotate the two halves of the shell over the long side. When opening and unfolding the suitcase, double the suitcase size area is required. The suitcase is maneuvered and moved on wheels arranged at one end across the width and depth of the suitcase. Travel suitcase utensils are distributed flatly in the suitcase in both halves of the bowl. At least one half of the shell can be separated by means of a tensioned net. Smaller travel utensils distribute and move throughout the entire shell while the suitcase is being transported.

US 2005/121275 describes a trolley case with a swivelling lid on top of the case and a downward swivelling lid on the front of the case. Inside, two open containers are attached to two opposite telescopic runners, the distances between which can be vertically expanded and compressed.

DE 20 2010 000 304 describes a trolley presentation case that can be expanded in vertical height.

SUMMARY OF THE INVENTION

The aim is to simplify a suitcase, a manufacturing process and a handling procedure in such a way that resources for manufacturing, handling, and the space required for storing, transporting and providing travel objects are conserved as far as possible and the travel objects are kept well sorted and the suitcase is lightweight.

A lightweight suitcase, in particular a travel suitcase, is described, comprising a cuboid suitcase over a suitcase length L, a suitcase width B and a suitcase depth T with a stable suitcase bottom and a stable suitcase lid, both of which span a suitcase surface over the suitcase width B and the suitcase depth T, with a suitcase wall material between suitcase bottom and suitcase lid, wherein the suitcase wall material forms the suitcase length L of the suitcase completely or partially in a clamping manner, wherein the suitcase wall material is fastened on at least three sides to the suitcase bottom and forms a circumferential lid opening on the opposite end along the suitcase length L, with a supporting linkage which comprises at least one translatory guide device, wherein the translatory guide device is secured to the inside of the suitcase lid, at least one supporting strut is secured to the suitcase wall material on the inside of the circumferential lid opening, and the translatory guide device is secured to the supporting strut, and by means of the translatory guide device the suitcase lid is parallel to the lid opening of a minimum, closed length Lmin to a maximum expanded, open length Lmax of the case, with wheels, wherein a front opening is formed with a front lid on the side of the suitcase rear wall opposite the suitcase rear wall and the suitcase rear wall and the front lid extend wholly or partly over the suitcase length and the suitcase width.

The suitcase is pulled up and opened by means of the built-in guide device. The suitcase thus forms a mobile closet without having to repack the luggage at the place of destination. The fact that the suitcase is essentially opened in the direction of room height does not double the floor space required to open the case. The suitcase keeps its room size from the width and depth it occupies on the floor surface. The length and width of the large suitcase surface remain upright in the room. This saves and compresses floor space resources considerably. The suitcase is a mobile closet with two states, one compressed and one expanded. Due to a lightweight construction, maximum weight restrictions in favour of travel objects can be adhered to and the carrier weight for lifting the suitcase is reduced.

In order to reduce the number of components and to achieve a lightweight construction while at the same time improving the stability of the case, the stable suitcase bottom is configured as a base pan, in particular with four circumferential lateral faces and rounded corners.

For the same advantageous reasons, the, in particular outer, stable suitcase lid is also configured as a cover shell, in particular with four circumferential lateral faces and rounded corners as a one-piece component, with at least one first opening centrally in the region of a side edge on the upper side of the suitcase lid for receiving a push-button from a locking mechanism and with a lifting handle recess device integrated on an end face complementary to the first opening in a side surface directed towards the bottom of the suitcase. The suitcase is thus protected against external influences. The canopy shell is thus a downward facing tub with four circumferential side walls of essentially the same height.

The lifting handle recess device is configured as a second opening at the front to accommodate a recessed grip shell over the two-dimensional side surface. Thus, the suitcase lid and the two recessed grip shells can be finished using inexpensive tools.

Further preferred to reduce component complexity and manufacturing time, as well as produce a lighter suitcase lid, the lift handle recess assembly includes the recessed grip shell as a one-piece component forming with the suitcase lid.

The suitcase bottom is configured as a complementary suitcase base pan. These circumferential side walls provide additional protection during transport in vehicles or freight compartments or on conveyor belts or collisions with other suitcases.

Further preferred are the suitcase lid and the base pan made of hard plastic. The hard plastic tub or shell, for example, is manufactured as a plastic injection-moulded part using an injection mould. In order to produce even more stable and at the same time essentially light and one-piece parts, the suitcase lid and the base pan can be made of aluminium or an aluminium alloy.

To improve the strength, the inside of the suitcase bottom, especially of the lid, is provided with support ribs, further preferred in honeycomb structure.

In order to facilitate the handling of the pull-out mechanism, at least one grip shell, preferably two grip shells over the depth of the case, is or is formed in the cover shell.

In order to realize lightweight, resource-saving suitcase construction, the suitcase wall material is made of a flexible, lightweight, thin-walled material, especially with an external textile structure. In order to produce a flat stability of the suitcase wall material, the suitcase wall material with support grooves is further preferably configured to be essentially parallel to the circumferential lid opening and spaced apart from each other, the distance interval of the support grooves being approx. 30-80 mm, in particular approx. 50 mm.

According to one design, the translatory guide device comprises a scissor mechanism, which can be pretensioned with a spring in particular, as is known from the state of the art for translatory lifting purposes.

In order to produce the suitcase as simply and stably as possible with a space-frame structure, the translatory guide device comprises a telescopic device with lockable telescopic runners, which preferably extend over the entire length of the suitcase, the locking mechanism being configured in particular to be integrated in the telescopic runners and two telescopic runners configured in parallel being releasable as a pair in the locking mechanism by means of a common push-button, the push-button and a push-button force-distributing strut being configured integrated in the suitcase lid and the telescopic runners being fastened to the suitcase base. The telescopic slides are preferably interlocked at the bottom and the inside of the suitcase lid. The push-button inserted into the first opening of the suitcase lid forms an essentially smooth, coherent outer surface towards the top of the suitcase lid when the lid is relaxed.

The push-button force distribution strut extends mainly over the depth inside the cover shell.

In order to secure the suitcase in the closed, compressed and expanded state, the locking mechanism has a locking point in the maximum extended state and at least one locking point in the minimum inserted state. This relieves the load on the lid of the suitcase and provides a double locking device.

In accordance with a preferred design, a telescopic runner is essentially formed in each corner of the suitcase as seen from the top of the lid. The telescopic slides in the corners of the suitcase thus stabilize the suitcase and form two functions: on the one hand, the telescopic slides serve as a load-bearing skeleton and frame of suitcase casings to form a cuboid suitcase and, on the other hand, the telescopic slides also serve as a translational suitcase opening function. In contrast, the suitcase opening function of conventional suitcases is shifted to a rotatory hinge. The present suitcase opening is divided into two openings, on the one hand a suitcase opening is created by a translational expansion of the suitcase height in the longitudinal direction of the suitcase and by opening another half by opening the front lid on the front side.

In order to insert and remove travel objects as easily and conveniently as possible, such as clothes, into and out of the suitcase configured as a mobile closet, the translatory guide device is configured with a range substantially corresponding in magnitude to the length of the suitcase, so that the height of the suitcase in the expanded state is substantially doubled and is configured with a trolley handle arranged on the rear wall of the suitcase by means of lockable telescopic runners, the height of the suitcase in the expanded state clearly exceeding the maximum length of the trolley handle in magnitude.

To ensure that the suitcase creates and divides the most efficient space possible for travel objects, the suitcase has a flexible partition with compartments parallel to the lid and parallel to the base of the suitcase. The compartments are configured to be variable to a compressed height kh in a compressed, closed suitcase state and to an essentially approximately doubled, expanded height eH in the expanded, open suitcase state with the maximum range of the suitcase lid extended.

In order to improve the loading capacity of the textile compartments of the room divider and thus increase the service life, a stiffening and reinforcing strut, preferably in the form of a metal or plastic rod, is provided on each bottom edge on the opening side of each compartment of the three-sided closed room divider, in particular the compartment bases of the room divider are made of a reinforced material such as plastic.

In order that the compartments retain their minimum space height advantageously in the compressed state and are arranged one above the other at an equal distance, the side walls of the compartments of the room divider are reinforced and of a stable design with a height 104 from the compartment base, which corresponds to a compressed height kh, in particular substantially in the amount of the length Lmin of the compressed suitcase divided by the number of compartments, and a flexible side wall of variable height is adjoined over the three closed sides of the compartments.

In accordance with a preferred design, a runner for accommodating objects, in particular coat hangers, is centrally located on the inside of the suitcase lid. Thus, clothes can be stored and transported directly on clothes hangers with the appropriate suitcase size.

In order to be able to hang clothes hangers on the outside of the suitcase lid, the suitcase lid has a circumferential groove on the upper side. A central handle in the lid of the suitcase is also preferred to be recessed outwards so that it is flush with the surface of the lid of the case, so that the groove is enlarged to form a recessed lid surface with the handle arranged centrally in the lid of the case.

In order to store and transport the travel objects in an orderly manner, boxes of such a height 104 are preferably formed and arranged in the compartments, so that the height 104 of the boxes essentially corresponds to the uniformly compressed height kh of all compartments in the compressed suitcase state, and the boxes in the compressed state of the suitcase are non-positively secured in the compartments, and in the expanded state with a compartment height eh can be loosely pushed in in the horizontal direction and pulled out.

In order to reduce the number of components, the weight and the production time, the suitcase bottom is formed in the corners of the outer surface of the suitcase bottom with wheel housing recesses, or in particular wheel carrier posts, preferably in one piece, and with rotatable wheels, wherein the wheels are rotatable through 360° about axes parallel to the working direction of the translatory guiding device of the case.

To ensure that the wheel housing recesses are shock-resistant and have a long service life, the wheel housing recesses on the inside of the suitcase base have a nest with reinforcing ribs, preferably star-shaped to the axis of rotation perpendicular to the suitcase base.

To ensure that the lid of the suitcase is secured to the suitcase housing and kept closed, the lid of the suitcase is configured with a manually operable first closure device, in particular a zipper, preferably a lockable buckle closure, in particular at the opening of the lid and, seen from above, a closed circular closure.

The front lid is preferably secured to the suitcase wall material by means of a second locking device, in particular a zip fastener, particularly preferably by means of a lockable buckle fastener. The front lid is pivotable or in particular rollable to one side of the case, in particular to the bottom side, preferably to the rear wall, preferably to the rear of the suitcase lid. The locking device can also be locked with a key or combination lock by means of a lock.

In accordance with an advanced design, the front lid can be closed with the first locking device over the width of the suitcase B and with the second locking device over the length of the suitcase L and attached to the base pan over the width of the suitcase B. The front lid can be closed with the first locking device over the width of the suitcase B and with the second locking device over the length of the suitcase L and attached to the base pan over the width of the suitcase B. Advantages are resource-saving handling of the locking device. A double locking function of the first locking device and barrier-free access to the compartments.

Alternatively, the front lid can be swivelled to the left, preferably to the right, on the longitudinal side of the case.

In order to make the suitcase even more resistant in the space-frame structure, the lid opening has a circumferential reinforced frame, in particular reinforced with an aluminium runner on the outer surface, and a closure device, further preferably a closable zipper.

According to an advanced design form to increase the strength, the supporting strut of the guide device is formed at least at the lid opening over the width of the suitcase at the rear wall, and in particular also at the front wall, of the case.

For improved handling, the corners are rounded, preferably with a rounding radius between 10-40 mm.

In order to transfer torsional forces from the trolley handle to the wheels shorter and easier, the telescopic slides of the trolley handle are mainly arranged at the outer corners of the back wall of the case.

In order to increase the transport capacity of the case, e.g. to accommodate electronic equipment, the telescopic runners of the trolley handle and the trolley handle enclose an outer pocket formed on the rear wall of the case.

In order to make the suitcase simpler than a trolley suitcase having at least two wheels which are each arranged at the end faces of the base width, a trolley handle is arranged by means of a telescopic device on the outer side of the suitcase opposite to the front lid over the length and width, preferably via two telescopic runners, and in the expanded state of the suitcase and an expanded telescopic device of the trolley handle the lid of the suitcase is configured to project by at least ⅓ of the total height of the expanded suitcase above the handle in terms of height.

In order to create a suitcase that is as light as possible and at the same time stable and resistant, the suitcase is made of a mix of plastic, aluminium and textile materials, with the lid and base of the suitcase made of plastic and the base frame, the telescopic runners made of aluminium materials and the lateral faces, in particular the front lid, made of textile materials.

In order to require little space to open the case, the front lid can be rolled up to the base according to a special design.

A lightweight suitcase with a mobile closet function is described, comprising a base pan, a suitcase lid in the form of a cover shell, wheels and telescopic runners mounted on the base pan, in particular rotatable through 360° perpendicular to the roller plane and plane of the base pan, with integrated locking as prefabricated components, and a flexible, lightweight suitcase wall material which is formed between the base pan and the cover shell, wherein the cover shell is configured to be lockable, translatory retractable and pull-out with the telescopic runners by means of a push-button integrated in the cover shell and an integrated push-button force-distributing strut and with a supporting strut, wherein the supporting strut is fastened at least one, preferably two, telescopic runners to the suitcase wall material, so that the suitcase is configured with a stable spatial structure forming a closet, in particular also for the expanded state. This creates a lightweight, resource-saving suitcase that combines at least two functions: the transport function of travel objects and a wall-mounted cabinet function of travel objects in the closed, compressed or expanded, open state.

A method for producing a suitcase, in particular one described above, is described, wherein a telescopic runner with integrated locking mechanism is inserted into each corner in a respective recess inside of a suitcase base made as a one-piece component base pan into a and is secured in a form-fitting manner, a supporting strut is inserted onto the telescopic runners and secured thereto, the supporting strut is fastened to the wall material, a push-button force distribution strut with a push-button is inserted into two telescopic runners with connection to the respective locking mechanism, and a suitcase lid is placed on the ends of the telescopic runners and secured in a positive-locking manner so that the at least one push-button is substantially flush with the surface side of the suitcase lid. Thus, a mobile closet is created by a simple plug-in and locking procedure.

According to a further method, a suitcase lid in the form of a cover shell is produced as a one-piece component with at least one opening centrally in the region of a side edge on the upper side of the suitcase to accommodate a push-button of a locking mechanism for actuating the guide device and with a lifting handle recess device integrated in the end face of the side complementary to the opening. This reduces the component effort and makes the suitcase lighter overall.

A method for handling a suitcase described above is provided, wherein a suitcase lid has at least one lateral lifting handle recess device on an end face and in each suitcase a push-button is arranged complementary thereto, respectively, the at least one push-button being pressed in order to release a lock in telescopic runners and to transfer the suitcase into an expanded or a compressed state and thus to open or close the suitcase.

The method is further preferred as follows, whereby the suitcase has boxes in compartments and the boxes are force-locked translative in the horizontal direction in the compartments when transferred into a compressed state due to the weight force of the compartments and boxes above and force-locked translative in the horizontal and vertical directions when transferred into an expanded state of the case. Even if the suitcase is not completely full, boxes in the suitcase create order and prevent the travel objects from wandering around in the travel transport of the suitcase.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
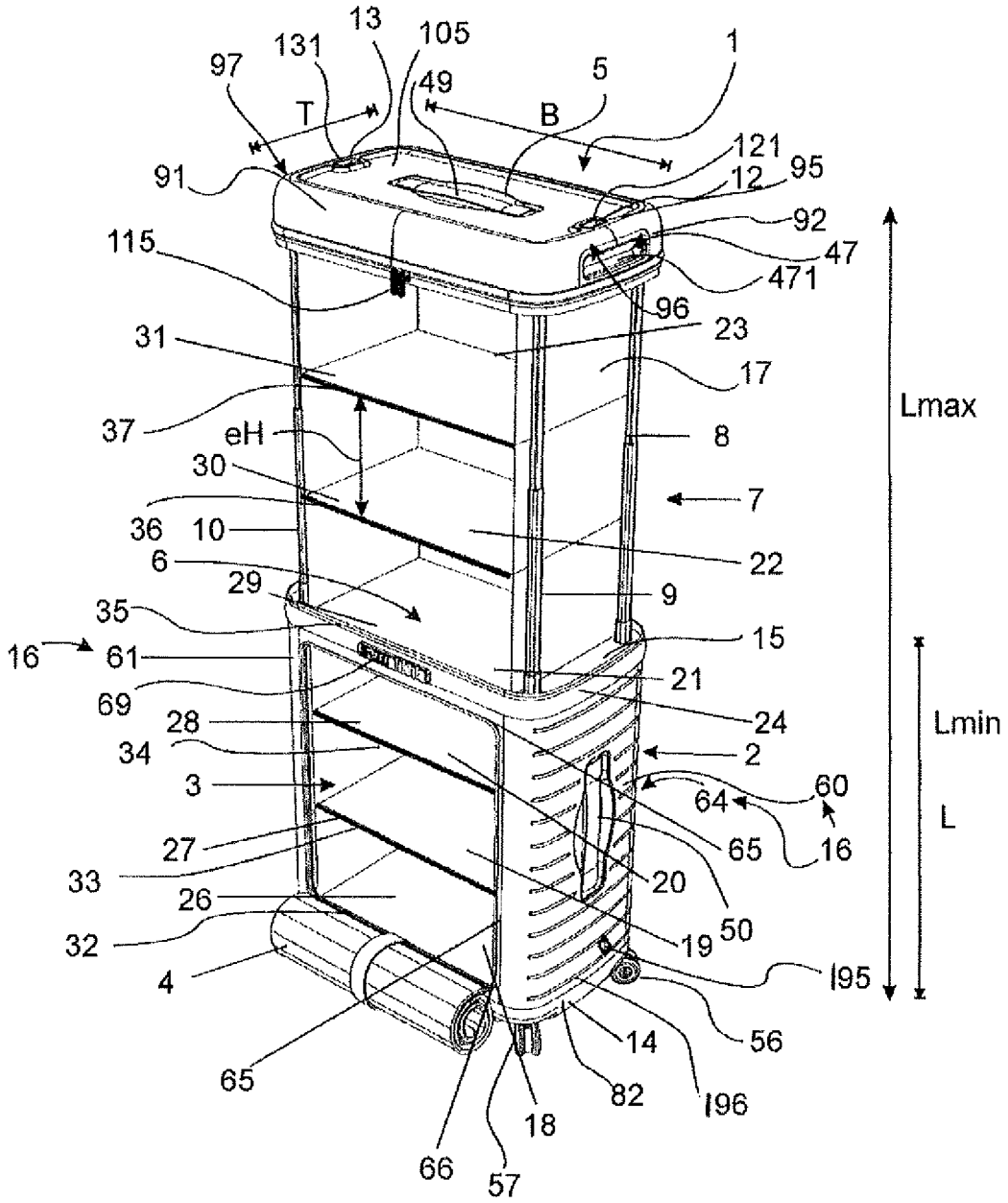
FIG. 1 a perspective view of an expanded suitcase.

FIG. 1 shows a perspective view of a lightweight suitcase 1, in particular a travel case, with a cuboid housing 2. The suitcase 1 has a front opening 3 with a flexible front lid 4 for the front opening 3. The front cover 4 can be flat or rollable as shown. The front cover 4 closes the front opening 3 with a zipper device 66. The zipper device 66 is sewn on the sides lengthwise from the two side walls 60, 61 and a front frame 65, which connects both side walls 60, 61 parallel to the rear wall 64. The side walls 60, 61, the rear wall 64 and the front frame 65 with the front lid 4 form the suitcase wall material 16. The front opening 3 covers one side of suitcase 1 over the length L and width B of suitcase 1.

The suitcase 1 has an outer suitcase lid 5 in the form of a cover shell, which extends over the depth T and width B of the suitcase 1 and is formed on one side of the suitcase perpendicular to the front lid 4. The suitcase lid 5 can be locked and pulled out parallel to a lid opening 6 with a translatory guide device 7. The suitcase lid 5 is centred in the area of a side edge 96, 97 on the upper side 95 of the suitcase lid 5 with first openings 121, 131 in size and shape for each of a push-button 12, 13 of a locking mechanism formed. The suitcase lid 5 is configured as a one-piece component, each with a side surface 92, 94 integrated at the front end in a lifting handle recess device 47, 48 which is complementary to the first opening 121, 131 and which is integrated in a side surface 92, 94 facing the suitcase bottom 14.

Figure 13:
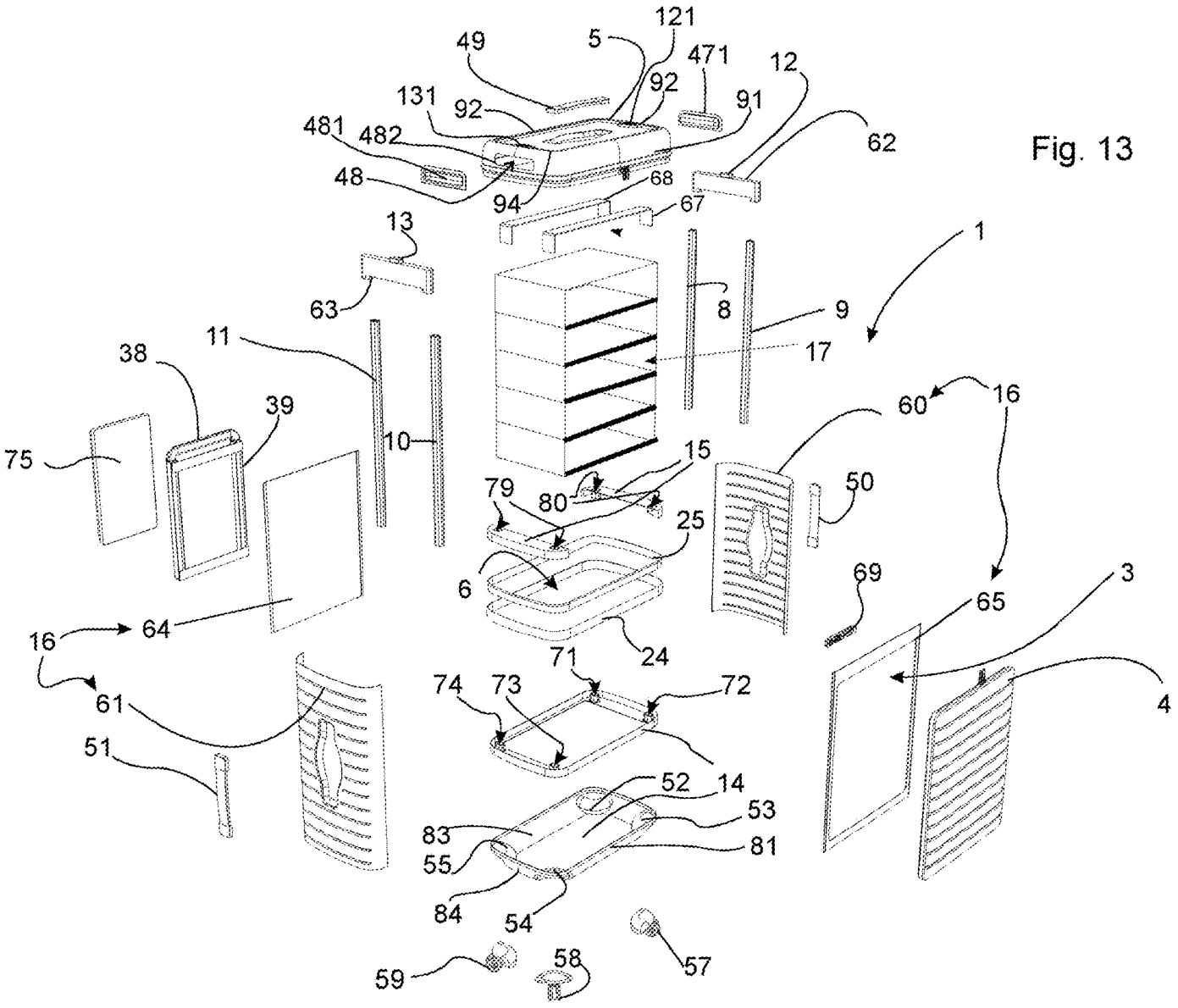
Figure 15:
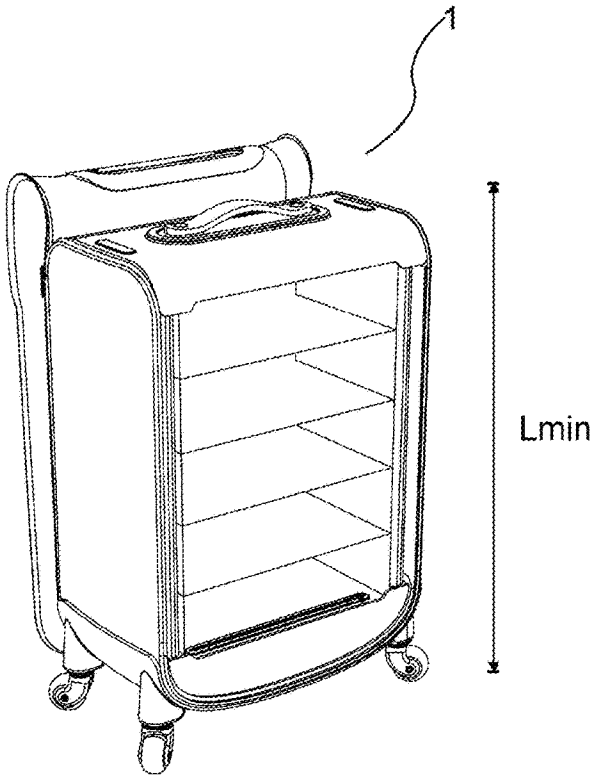
Figure 14:
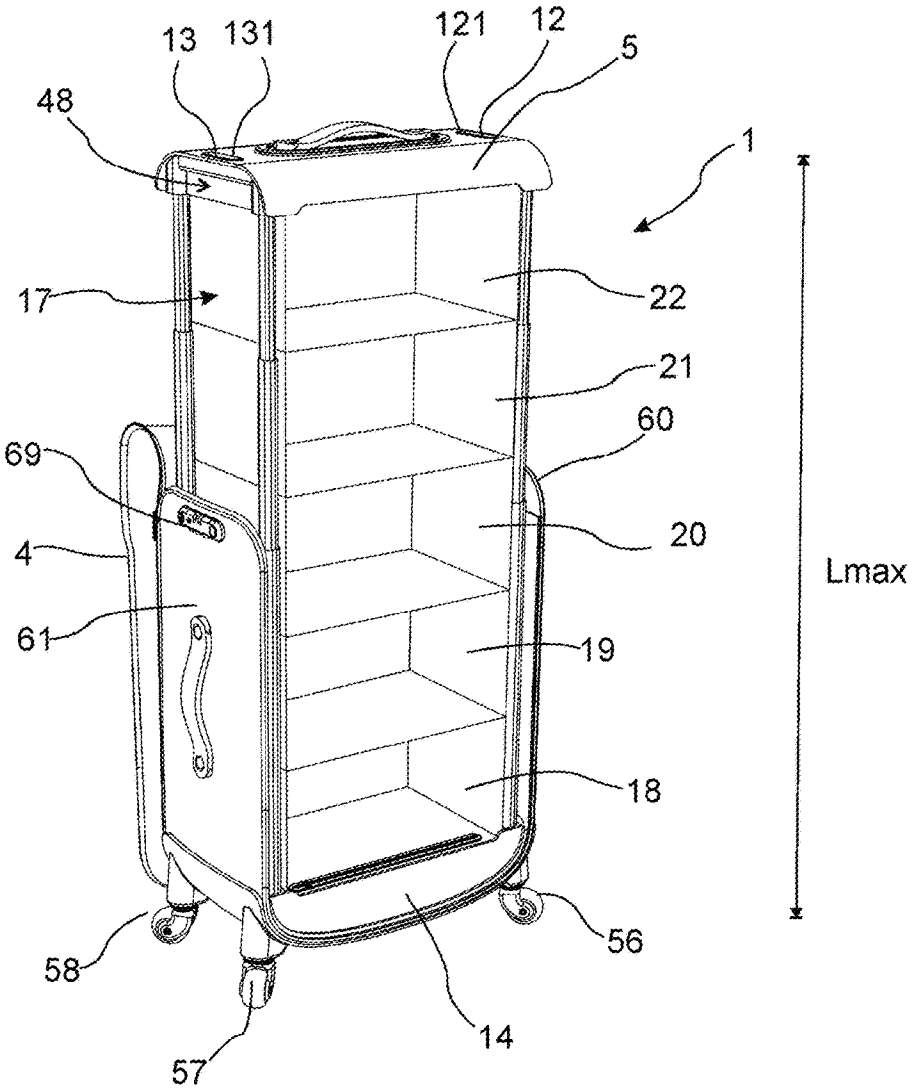
Figure 18:
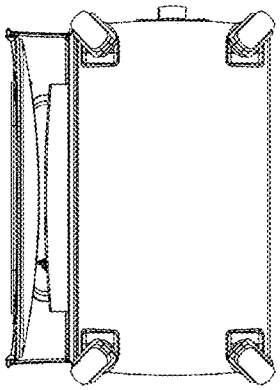
Figure 19:
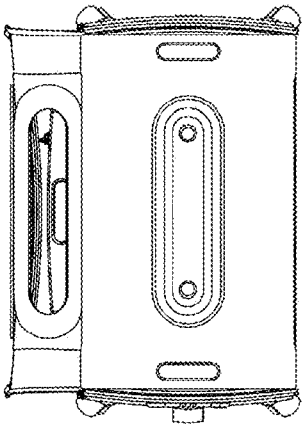
Figure 17:
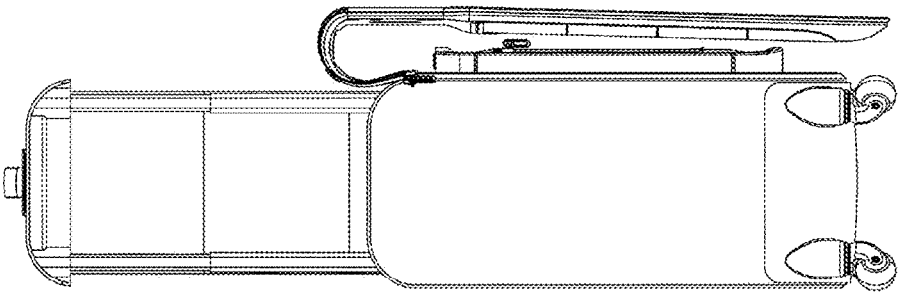
Figure 16:
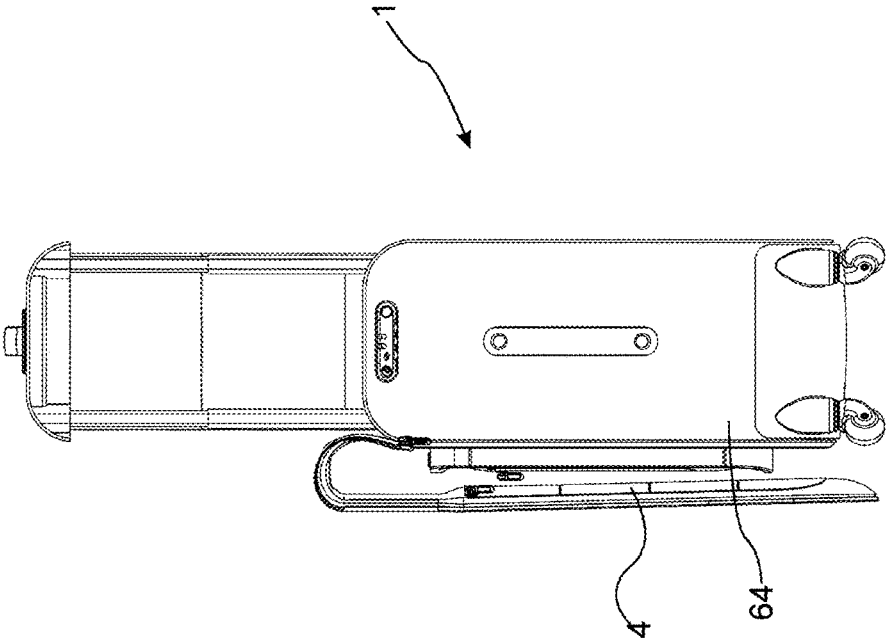
Figure 21:
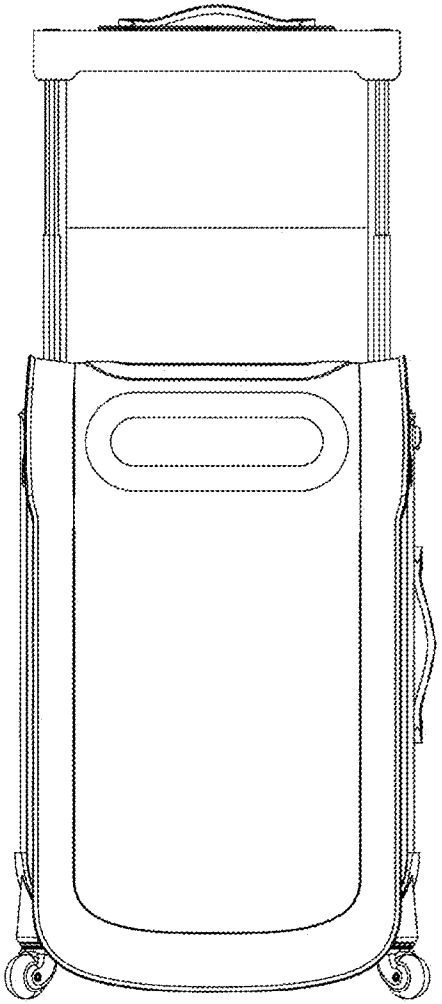
Figure 20:
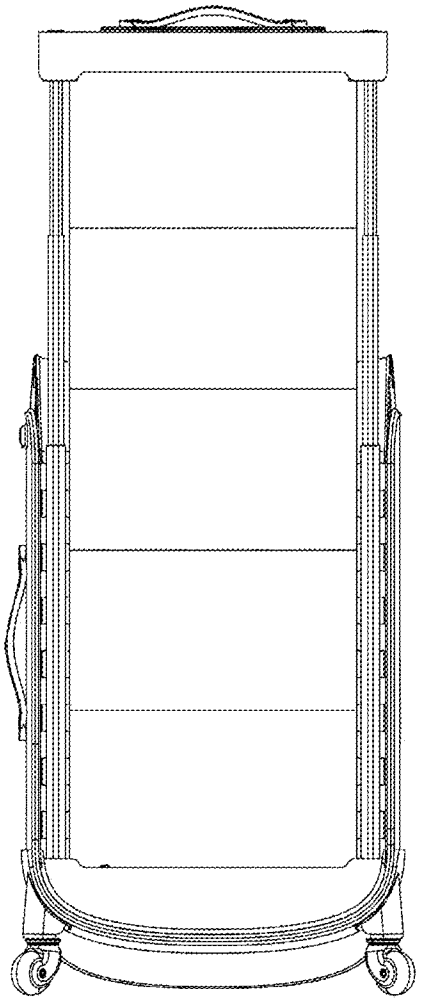

The lifting handle recess device 47, 48 comprises a second opening 482 on the strand side to accommodate a handle recess shell 471, 481 via the two-dimensional side surface 92, 94, each as shown in detail in FIG. 13. In the suitcase lid 5, in the region of two opposite side edges 96, 97 above the depth T of the suitcase 1, the prestressed push-button 12, 13, which is inserted into the openings 121, 131, is formed in the region of two opposite side edges 96, 97, in each case, which cooperates with a locking mechanism of the translatory guide device 7, so that when both push-buttons 12, 13 are pressurised, the locking can be released by means of the locking mechanism integrated in the guide device 7. The surfaces of the push-buttons 12, 13 are flush and smooth with the surface of the upper side 95 of the adjacent suitcase lid 5 in the relaxed, locked state of the guide device 7. To release the lock, press the push-buttons 12, 13 into the suitcase lid 5 so that they form a recess on the surface of the suitcase lid 5. Thus, the push-buttons 12, 13 are protected against damage and incorrect operation.

Figure 3:
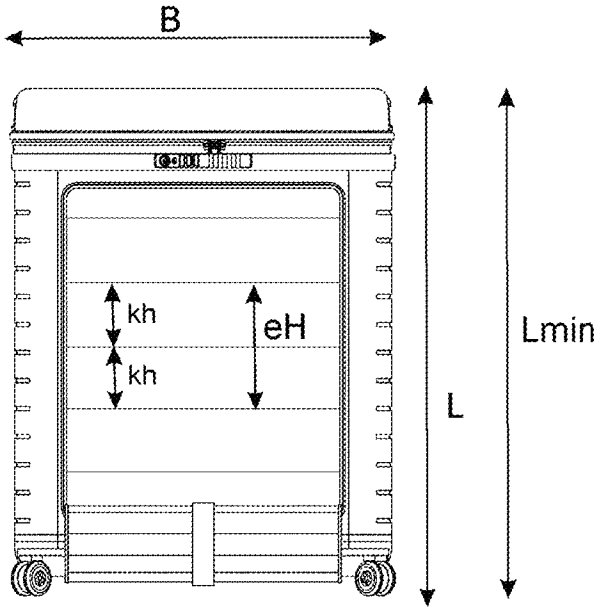
FIG. 3 a front view of a compressed case.
Figure 5:
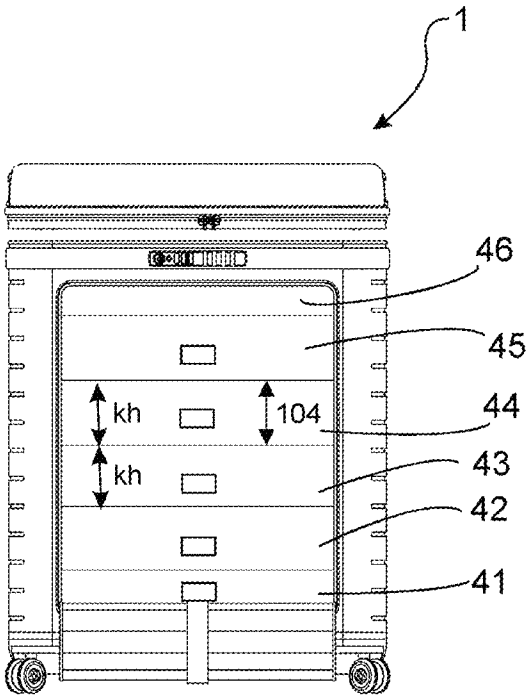
FIG. 5 a front view of a compressed suitcase with boxes.
Figure 4:
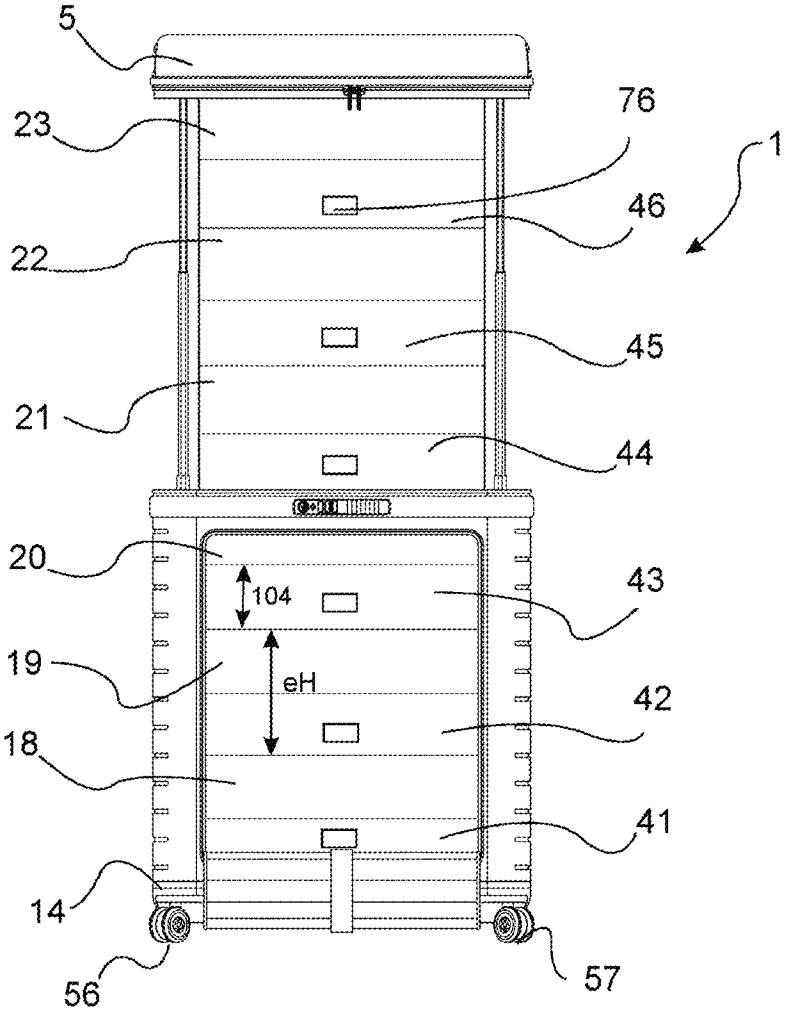
FIG. 4 a front view of an expanded suitcase with boxes.

Case 1 is equipped with a flexible room divider 17 with compartments 18-23 parallel to suitcase lid 5 and parallel to a suitcase base 14. The compartments 18-23 have a flexible height and are configured to a compressed height "kh" in a compressed, closed suitcase state with a length Lmin as shown in FIGS. 3, 4 and 5 and to an expanded height "eH" in an expanded, open suitcase state with a maximum extended range changeable to a length Lmax of the suitcase lid 5. The suitcase wall material 16 thus forms a light supporting structure between the suitcase lid 5 and the suitcase bottom 14 together with the guide device 7 and a supporting strut 15 which is attached to the suitcase wall material 16 and supports the guide device 7.

The suitcase 1 has as translatory guiding device 7 a telescopic device with telescopic runners 8, 9, 10, 11, which extend over the entire length L of the suitcase 1 at the corners with a top view of the suitcase lid 5. The telescopic slides 8-11 form a frame or suitcase skeleton for stabilizing and shaping the suitcase 1.

The suitcase lid 5 is configured as a downward facing tub with four circumferential side walls 91-94 of essentially the same height.

The suitcase base 14 is configured as a complementary suitcase base pan with four circumferential side walls 81, 82-84 of essentially the same height.

FIGS. 1, 2, 4 and 7 show that the translatory guide device 7 is configured with a range substantially corresponding in amount to the length L of the suitcase 1, so that the height eH of the compartments 18-23 of the space divider 17 is substantially doubled in the expanded state.

The compartments 18-23 of room divider 17 of suitcase 1 comprise a textile or textile structure and each have a stiffening and reinforcing strut 32-37 on each floor edge for opening the room divider 17, which is closed on three sides. This brace 32-37 is preferably configured as a plastic or metal rod. The compartment shelves 26-31 of room divider 17 are made of a preferred variant of a reinforced material such as plastic or configured as a plastic insert. The suitcase wall material 16 is configured with a support structure, the supporting structure being formed of support grooves or supporting grooves 196 with a distance interval 195 of approx. 30-80 mm, in particular approx. 50 mm. The support grooves 196 run parallel to the peripheral edge of the lid opening 6. It goes without saying that the suitcase wall material 16 can also have equivalent supporting structures, such as a honeycomb structure or similar supporting structures with supporting grooves and/or supporting elevations.

Figure 8:
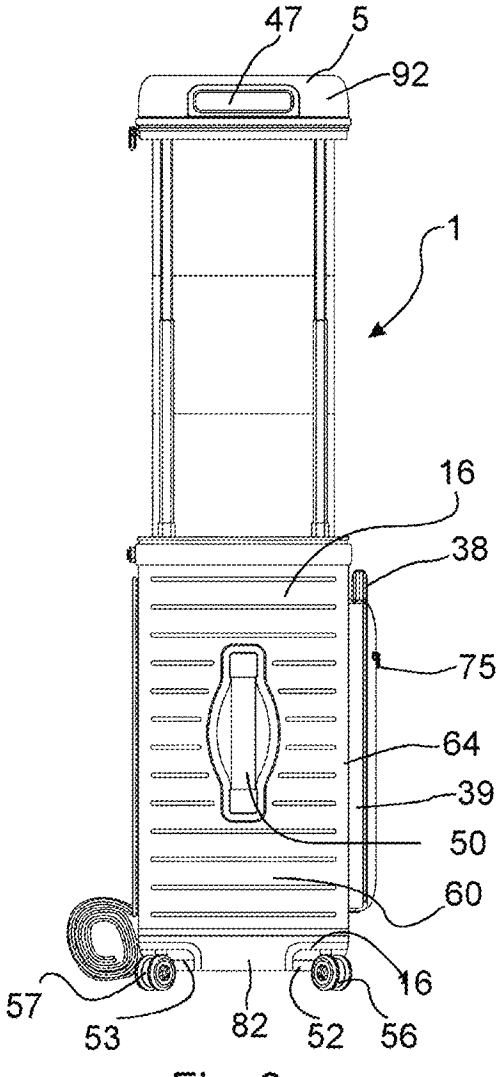

The suitcase base 14 is configured with integrated wheel housing recesses shown in FIG. 8, 9, in which wheels or castors 56, 57, 58, 59 are mounted which can be rotated through 360° perpendicular to the roller plane.

The suitcase lid 5 can be closed with a zipper as closing device 115 at the lid opening 6 and with a lock, preferably a combination lock, 69 at a base frame 24, it can be secured and locked. The base frame 24 is attached to the outside of the suitcase wall material 16.

The suitcase lid 5 has a circumferential groove 105, which is enlarged to form a surface in which a suitcase lid handle 49 is centrally and centrally recessed again with a recessed grip. The suitcase side walls 60, 61 are equipped with recessed grip recesses and suitcase side wall handles 50, 51 on both sides.

Figure 2:
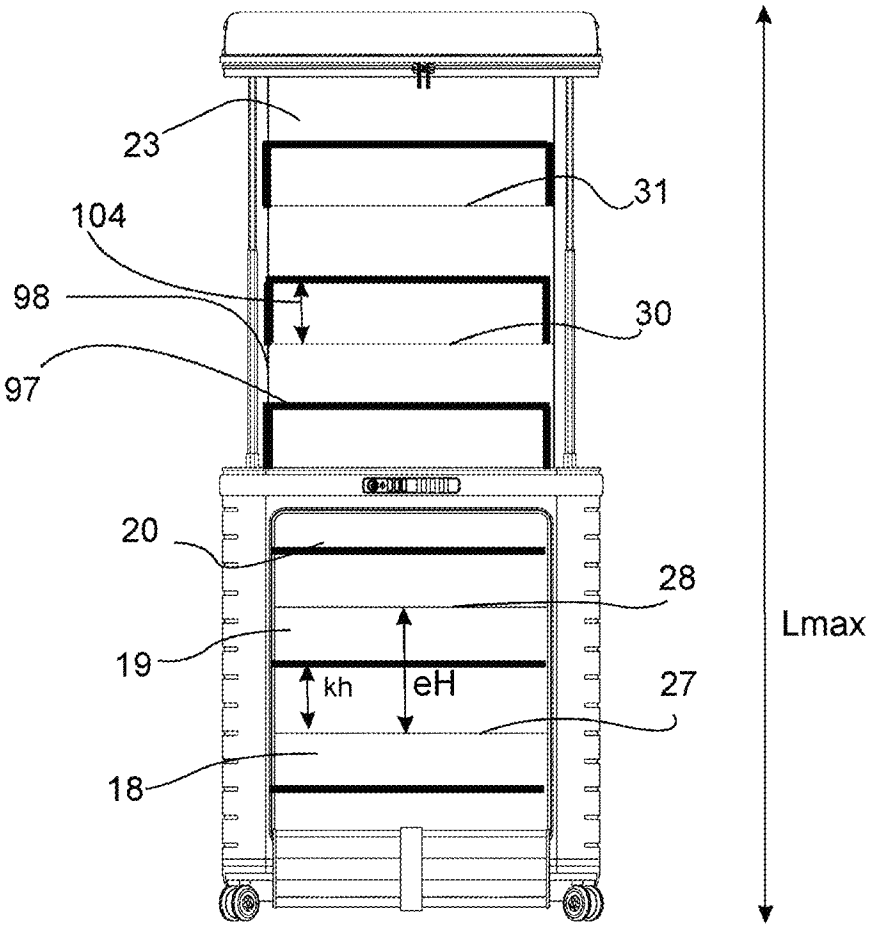
FIG. 2 a front view of an expanded suitcase.

FIG. 2 shows the expanded suitcase 1 with a further training room divider 17 with reinforced side walls 97 and adjoining variable side walls 98 assembled from each shelf 26-31 in each shelf 18-23. The reinforced side walls 97 have a height 104, which corresponds to the compressed height kh. Thus, the compartments 18-23 always have the same compartment height kh even when compressed.

FIG. 3 shows suitcase 1 in compressed suitcase condition. The suitcase lid 5 is closed and closed with the closing device 115, the zipper, by means of the lock 69, the base frame 24 and suitcase wall material 16. The front cover 4 can be folded down to the floor or rolled up as shown and secured with a strap. Compartments 18-23 are reduced to a compressed height "kh", which corresponds to about half of an expanded height "eH".

The procedure for handling suitcase 1 is as follows. Manual intervention is required in the lateral 47, 48 lifting handle recess devices, which are formed in the suitcase lid 5 over the depth T of the case. The push-buttons 12 and 13 are complementary and ergonomic to each other. Both push-buttons 12, 13 are pressed manually with the thumb of one hand to release a lock in each telescopic runner 8-11 in pairs on the same side and to transfer the suitcase 1 into an expanded or a compressed state regarding the height of the compartments 18-23 by pulling up or pushing down the suitcase lid 5. An expanded suitcase opens access to the upper half of compartments 18-23 and expands the height of the lower compartments 18-23 or vice versa with a compressed suitcase 1 the compartments 18-23 of the upper half are closed into suitcase 2 of suitcase 1. The compartments 18-23 are only accessible via the front opening 3 when the suitcase is compressed.

FIGS. 4 and 5 show the suitcase 1 in the front view with boxes or drawers 41-46 once with expanded compartment height "eH" and once with compressed compartment height "kh". The boxes 41-46 are configured and arranged in the compartments 18-23 with such a height 104 that the height 104 essentially corresponds to the compartment height kh in the compressed suitcase state. The boxes 41-46 are thus force-locked in the compressed state of suitcase 1 in compartments 18-23. In the expanded state, the boxes 41-46 can be pushed in and pulled out loosely in the horizontal direction.

The procedure for handling suitcase 1 with boxes 41-46 in compartments 18-23 is as follows. When the boxes 41-46 are transferred into a compressed state, they are force-locked in the horizontal direction in the compartments 18-23 by force-locking translational locking due to the weight force of the compartments 18-23 above and the boxes 41-46 by force-locking translational unlocking in the horizontal and vertical direction when they are transferred into an expanded state of the suitcase 1. This means that the 41-46 boxes are secured simultaneously with compression of the luggage.

The outer corners of suitcase 1 at suitcase bottom 14 and of suitcase lid 5 are rounded, preferably with a radius of curvature of at least 10 to 50 mm.

The suitcase 1 has 14 wheels 56, 57, 58, 59 rotatable through 360° in the corners of the outer lower surface of the suitcase base around axles 77,78 parallel to the front side of the case, 56, 57, 58,59 rotatable through 360°.

Figure 6:
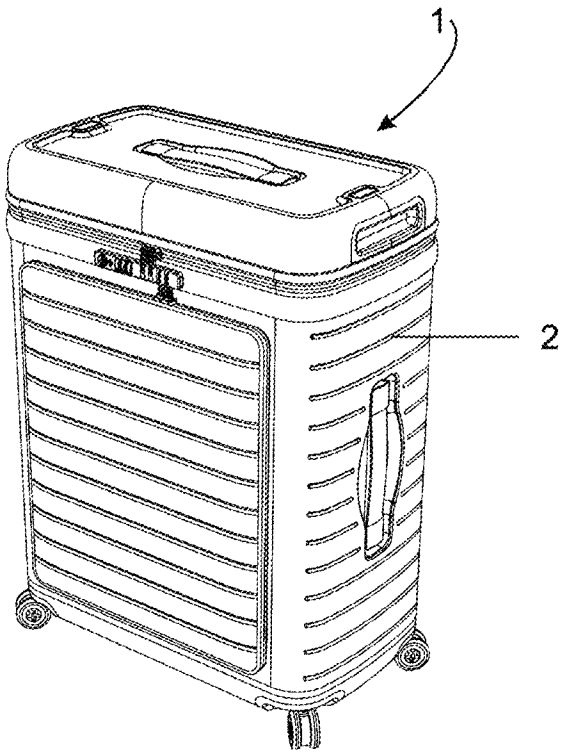
FIG. 6 a perspective view of a compressed, closed suitcase.

FIG. 6 shows a perspective view of a compressed, closed suitcase 1.

Figure 7:
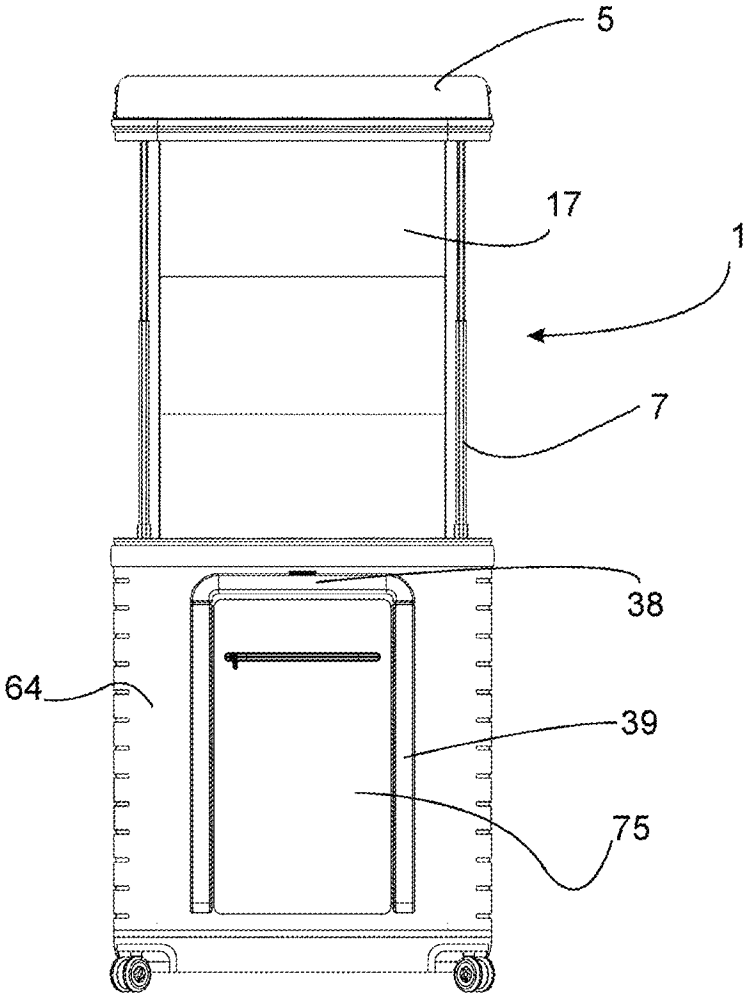
FIG. 7 a rear view of an expanded suitcase.

FIG. 7 shows the rear view of an expanded suitcase 1. The suitcase 1 has a trolley handle 38 with a trolley telescopic device 39 on the rear wall 64 on the outer side of the suitcase over the suitcase length L and suitcase width B opposite to the front lid 4. The trolley telescopic device 39 comprises two telescopic runners. In the expanded state of the suitcase 1 and an expanded, extended trolley telescopic device 39 of the trolley handle 38, the suitcase lid 5 is formed to project in height by at least ⅓ of the total height of the expanded suitcase 1 above the trolley handle 38. Thus, the suitcase 1 forms a mobile closet in the expanded condition and the suitcase objects such as clothes are ergonomically in the height in the suitcase 1 insertable and removable. No additional floor space is required for this. The telescopic runners 39 of the trolley handle 38 and the trolley handle 38 enclose an outer pocket 75 on the rear wall 64 of suitcase 1.

Figure 9:
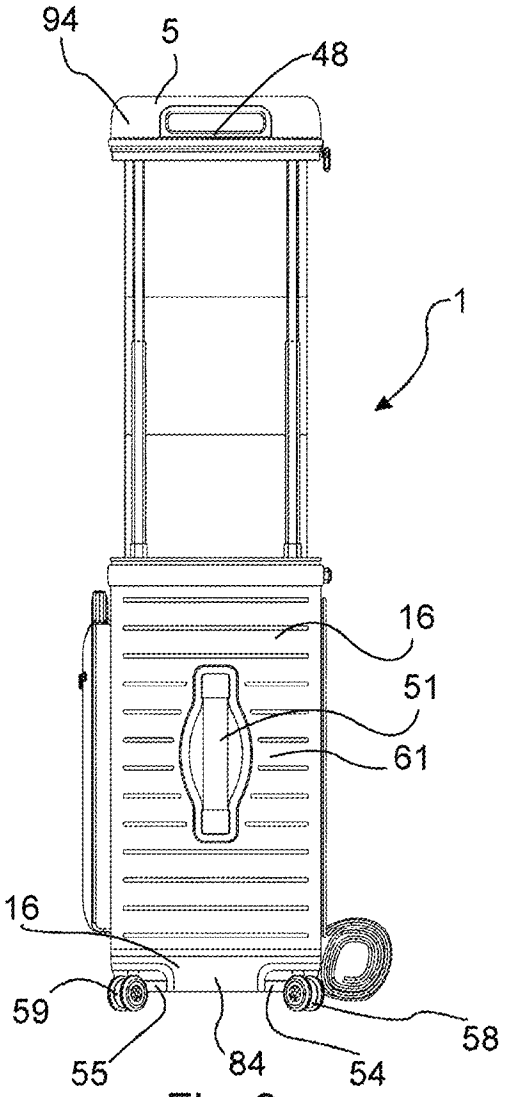
FIGS. 8 and 9 a side view right and left of the expanded case.

FIGS. 8 and 9 show a side view to the right and left of the expanded case. 16 recessed side handles 50, 51 are provided in the side walls 60, 61 of suitcase 1, which can be folded out of holders or pulled out to the surface of the suitcase wall material. Wheel housing recesses 52-55 are integrated in the suitcase bottom 14 and the corresponding lateral faces 81, 82, 83, 84, for example as a plastic injection-moulded part as a complete component. Wheels 56-59 are located in the outer corners of wheel housing recesses 52-55.

In the lateral faces 92, 94 the lifting handle recess devices 47, 48 are provided for ergonomic handling of the suitcase lid 5.

Figure 10:
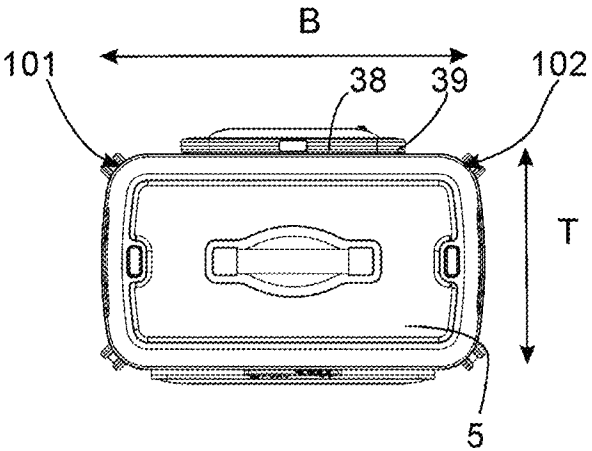
FIGS. 10 and 11 a top view and a bottom view of the case.
Figure 11:
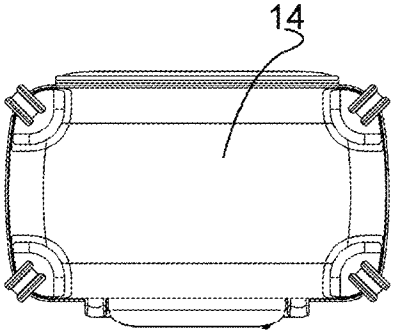

FIGS. 10 and 11 show a top view with the suitcase lid 5 and a bottom view of the suitcase with the suitcase bottom 14.

Figure 12:
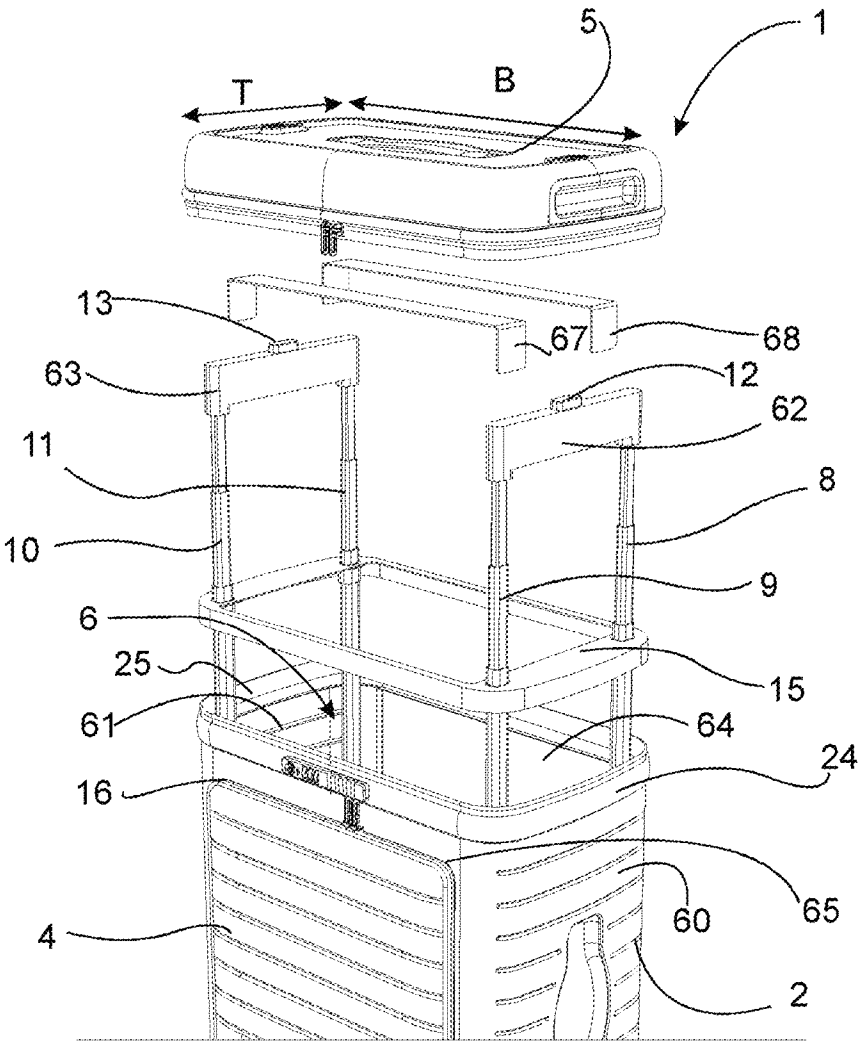
FIG. 12 a perspective view to assemble the lid of the suitcase with the snap fasteners and FIG. 13 an exploded view of the suitcase, FIG. 14-23 Perspective and analogue views of an expanded suitcase according to a second design, FIG. 24 An inner side of the suitcase base with reinforced honeycomb structure and ribbed structure for the wheel housing nest, FIG. 25-FIG. 31 Views of another third embodiment of the suitcase and FIG. 32 a schematic view of a fourth design.

FIG. 12 shows a perspective view of the assembly of the suitcase lid 5 with the push-buttons 12, 13. An inner frame reinforcement 25 as a ring corresponds to a base frame 24 and is attached to the inside of the suitcase wall material 16, whereas the base frame 24 is located on the outer surface of the suitcase wall material. These form the lid opening 6 in the circumference of the suitcase wall material 16. The supporting strut 15 is depicted in this figure as a circumferential ring. It goes without saying that the supporting strut 15 can each be two hard plastic components which each accommodate two telescopic runners 8-11 on one side of the suitcase and are each fastened separately to a suitcase wall 60, 61 via the depth T of the case. Connecting struts, for example made of hard plastic over the width of the suitcase B, are then advantageously omitted for reasons of resources and weight.

The base frame 24 is preferably made of a high-strength material, such as aluminium at the upper end of the suitcase wall material 16 mounted on the side walls 60, 61, the rear wall 64 and the front frame 65.

A push-button force distribution strut 62, 63 each with a centrally formed push-button 12, 13 extends substantially over the depth T on the side of the suitcase 1 inside the suitcase lid 5 and distributes the pressure exerted on the push-button 12, 13 to the locking mechanism in each telescopic runner 8-11. A preload from each locking mechanism is also transmitted to the push-button force distribution strut 62, 63 as a counterforce.

On the lower inside of the suitcase lid 5, supports 67, 68 are provided for fastening the room divider 17 not shown.

Figure 24:
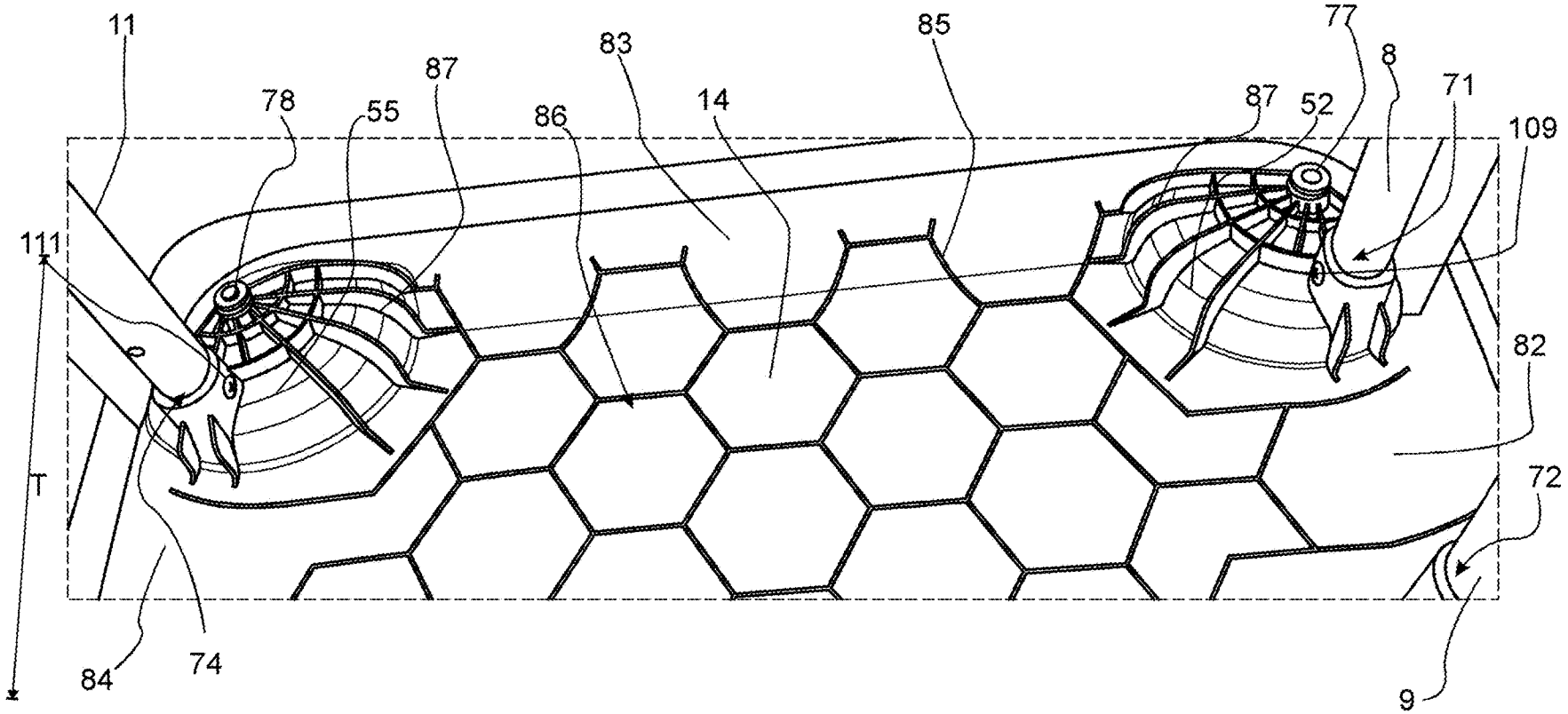

FIG. 13 shows an exploded view of suitcase 1. Thus, a procedure for the production of a suitcase 1 is better illustrated. A telescopic runner 8-11 with integrated locking mechanism is inserted into a one-piece suitcase base 14 as a base pan, in particular as shown in FIG. 24, into a corner inside in a recess 71-74. As shown in FIG. 13, the bottom of the suitcase 14 can be made of two or more parts with respect to the wheel housing. For reasons of weight and resources, the bottom of the suitcase 14 is preferably made in one piece. Each telescopic slide 8-11 is secured with pins or screws as shown in FIG. 24. A load-bearing strut 15 with two recesses 79, 80 is put onto a side pair, two telescopic runners 8-11 and secured to these with a positive fit. The supporting strut 15 is attached to the suitcase wall material 16. A push-button force distribution strut 62, 63 is inserted with a push-button 12, 13 into two telescopic runners 8-11 with connection to the respective locking mechanism. The suitcase lid 5 is pushed onto the ends of the telescopic slides 8-11 and secured with a positive fit so that the at least one push-button 12, 13 is inserted into the first opening 121, 131 and is essentially flush with the surface side of the upper side 95 of the suitcase lid 5. A recessed grip shell 481 is inserted into the second opening 482 in the middle of the suitcase depth T in the cover shell forming the suitcase lid 5.

Contrary to the illustration in FIG. 13, the suitcase base 14 is preferably made in one piece with integrated wheel housing recesses 52-55 and with rotation axles 77, 78 mounted on them, as shown in FIG. 24. Separate wheel housings as shown in FIG. 13 can therefore be dispensed with for reasons of weight and resources.

The suitcase 1 is made of a material mix of plastic, aluminium and textile materials. The suitcase lid 5 and the suitcase bottom 14 are made of plastic. The base frame 24 and the telescopic slides 8-11 comprise aluminium materials. The side walls 60-65 and lateral faces, in particular the front cover and the rear wall, are preferably made of textile materials.

FIGS. 14 to 23 show the lightweight suitcase 1 in an alternative design with improved mobile closet function. The reference signs are identical for the same functions in both embodiments for simplification. To simplify matters, changes to the second form of execution are described in comparison to the first form of execution.

Figures 22, 23:
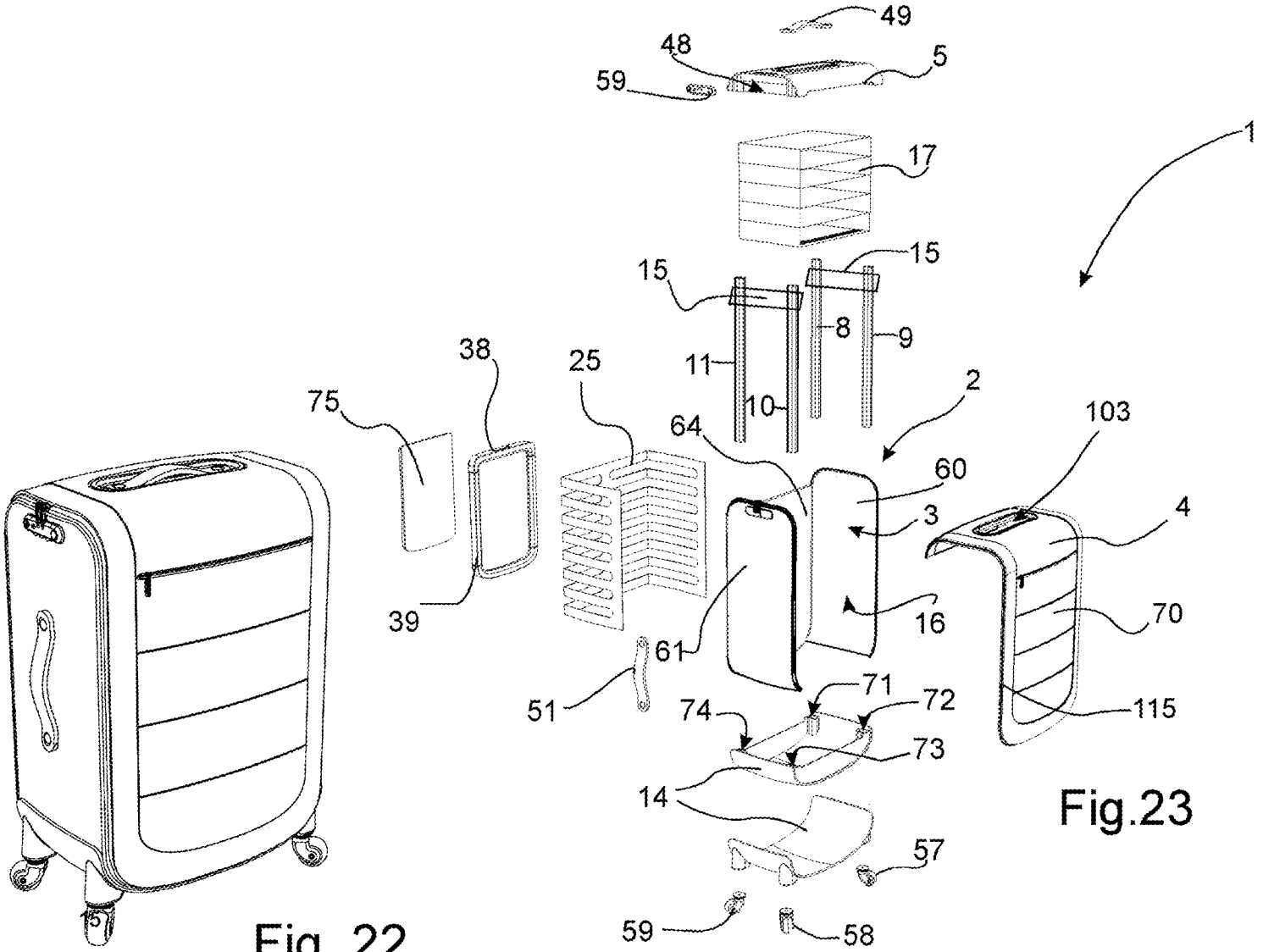

In this suitcase 1 is barrier-free, no ring-shaped, reinforced, outer base frame 24 arranged. Instead of the reinforced base frame 24, the inner frame reinforcement 25 of this design, as shown in FIG. 23, is C-shaped in plan view with an open side for the front opening 3. This design thus offers free, even access to the compartments 18-22 over the entire extended length Lmax of the suitcase 1.

In contrast to the first embodiment, the suitcase 1 has five compartments 18-22, but can be produced in any number of compartments 18-22, depending on the user's requirements.

The suitcase 1 can have a formed suitcase bottom 14 according to the first design or alternatively, as shown, the wheels 56-59 are formed on studs protruding from the suitcase bottom 14.

The front lid 4 is extended on the rear wall of the suitcase 64 and encloses and covers the suitcase lid 5 when closed as shown in FIG. 22. When folded back, the front lid 4 releases the suitcase lid 5, as shown in FIG. 14-21. The front cover 4 has a cut-out 103 so that the suitcase cover handle 49 of the suitcase cover 5 can be reached through the front cover 4. The zipper as closing device 115 runs along the front edges of the front sides 60, 61 up to the width of the suitcase bottom 14.

The lifting handle recess device 47, 48 includes the handle recess shell as a one-piece component forming with the suitcase lid 5. This reduces the component effort and makes the suitcase lighter.

The lock 69 for locking and securely closing the zipper 115 is arranged on one side 61 of suitcase 1.

FIG. 23 shows an exploded view of suitcase 1. FIG. 23 shows the box base 14 formed of two components. Preferably, however, the box base 14 is configured in one piece, for example as an injection-moulded component and, therefore formed of one component. The reinforced C-frame as inner frame reinforcement 25 can be configured as a grid as shown in FIG. 23. The reinforced C-frame 25 can also be configured as an open bracket according to the first design, which can merge with the load-bearing strut 15 to form a component or can be formed in several parts in addition to the load-bearing strut 15. This design does not include a front frame 65 as suitcase wall material 16. In addition, the front cover 4 can have a front outer pocket 70 with zipper both in this and in the design described above.

FIG. 24 shows the inside of the suitcase bottom 14 with support ribs 85. The suitcase base 14 is preferably manufactured in one piece as an injection-moulded component with the support ribs 85 in a honeycomb structure 86 on the inside and on the outside, preferably smooth. This reinforces the flat suitcase bottom 14 against external pressure and shear loads. It goes without saying that the inside of the suitcase lid 5 can also be configured as a one-piece component with such a honeycomb structure 86. For simplification, this is not shown in an explicit figure. The honeycomb structure 86 runs up to the circumferential lateral faces 82, 83, 84.

The wheel housing recesses 52, 54 shown form a nest for the rotation axis 77, 78 accommodated therein and for a wheel 56-59 movable through 360° around the rotation axis. From the axis of rotation 77, 78 of the wheels, reinforcing ribs 87 are radiating like a star perpendicular to the bottom 14 of the case. In addition, ring segments are formed as reinforcing ribs 87 around the centre of the rotation axis 77, 78. The ends of the telescopic slides 8-11 are inserted into recesses 71, 72, 74 at the front side walls 84, 82 of the base pan, which extend over the depth T, and are positively secured to the base pan with locking screws or locking bolts 109-111 transverse to the direction of insertion. The recesses 71, 72, 74 for the telescopic slides 8-11 are formed as one component on the relief of the inside of the luggage base 14. The recesses 71, 72, 74 have vertical reinforcing ribs 87 to the suitcase bottom 14. For simplification, only the telescopic slides 8, 9, 11 are shown.

FIG. 25-FIG. 31 show views of another third embodiment of the suitcase 1. In this embodiment, the front lid 4 can be folded away to the side. The base pan has parallel grooves on the outside for stiffening and the wheel housing recesses are only slightly indicated and not pronounced.

FIG. 32 shows a schematic view of a fourth design. This embodiment essentially corresponds to the first and third embodiments with the further training that the front lid 4 is lockable with the first locking device 115 over the suitcase width B and with the second locking device 66 over the suitcase length L and fastened to the base pan over the suitcase width B. The front lid 4 is lockable with the first locking device 115 over the suitcase width B and with the second locking device 66 over the suitcase length L and fastened to the base pan over the suitcase width B. The front lid 4 is lockable with the first locking device 115 over the suitcase width B.

The previously described variations of the method and the device serve only to better understand the structure, function and properties of the solution presented; they do not restrict the disclosure of the embodiment examples. The Fig. is presented schematically, whereby essential properties and effects are sometimes significantly augmented in order to clarify the functions, mechanisms of action, technical embodiments and features. In doing so, each function, each principle, each technical embodiment and each feature, revealed in the Fig or in the text, with all claims, each feature in the text and in the other Fig., other functions, principles, technical embodiments and features contained in this disclosure or resulting therefrom, are freely and optionally combined, so that all possible combinations of the described solution are referenced. In doing so, combinations of all individual embodiments in the text, i.e. in each section of the description, in the claims and also combinations of different variations in the text, in the claims and in the Figures, are included.

The device and method details set out above are thus presented in context; it should be noted, however, that they are independent of each other and can be freely combined with one another. The interrelations of individual parts and sections thereof shown in the figures and their dimensions and proportions are not intended to be restrictive. Individual dimensions and proportions may deviate significantly from those displayed.

The claims also do not limit the disclosure and thus the combination options of all displayed features. All the features are explicitly available separately and in combination with all other features disclosed here.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lightweight travel suitcase comprising:

a cuboid housing extending over a suitcase length, a suitcase width and a suitcase depth, the housing having a suitcase base having wheels and a suitcase lid, both of which span a suitcase surface over the suitcase width and the suitcase depth, and the housing having a circumferential lid opening that is covered by the suitcase lid, a supporting linkage comprising at least one translatory guide device that is fastened to an inside of the suitcase lid, the translatory guide device provided to guide the suitcase lid parallel to the lid opening between a minimum closed length of the suitcase to a maximum expanded open length of the suitcase, wherein the housing further comprises a suitcase rear wall and a front opening that is formed with a front lid on a side of the housing opposite the suitcase rear wall, the suitcase rear wall and the front lid extending wholly or partially over the suitcase length and the suitcase width, wherein the housing further comprises a flexible partition having compartments parallel to the suitcase lid and parallel to the suitcase base, the compartments being variable between a compressed height in a closed state of the suitcase when the suitcase lid is at the minimum closed length of the suitcase and an expanded height in an open state of the suitcase when the suitcase lid is at the maximum expanded open length, wherein the suitcase further comprises a push-button of a locking mechanism to release a locked position of the translatory guide device, wherein the translatory guide device comprises lockable telescopic runners, the locking mechanism being integrated in the telescopic runners, and two of the telescopic runners that are parallel to each other form a pair by a common push-button of the locking mechanism, wherein the suitcase base is configured in the shape of a base pan with four circumferential lateral faces and is made as a one-piece-component having the wheels, which are mounted on the base pan, wherein the suitcase lid is configured as an outer cover shell with circumferential lateral faces and is made as a one-piece-component, wherein the lateral faces of the suitcase lid have a lateral face width which comprises a lifting handle recess therein, wherein the suitcase is made out of a material mix with flexible suitcase walls made out of lightweight material that extend between the suitcase base pan made out of a hard material to be stable and the suitcase lid made out of a hard material to be stable, and wherein the suitcase walls are fastened on at least three sides of the suitcase base pan.

2. The suitcase according to claim 1, wherein the suitcase base has rounded corners, wherein the suitcase lid has rounded corners and at least one first opening centrally in a region of a side edge on a top side of the suitcase lid for receiving the push-button of the locking mechanism and having a lifting handle recess device integrated in one of the lateral faces of the suitcase lid that extends in a direction of the suitcase depth.

3. The suitcase according to claim 2, wherein the lifting handle recess device comprises an end-side second opening for receiving a handle recess shell to form the lifting handle recess.

4. The suitcase according to claim 3, wherein the suitcase lid and the suitcase base pan are made of hard plastic, wherein an inside of the suitcase base is formed with supporting ribs, and wherein the handle recess shell is formed as a one-piece component with the suitcase lid.

5. The suitcase according to claim 1, wherein the flexible lightweight material of the suitcase walls have a textile structure on the outside and is formed with a supporting structure, the supporting structure being supporting grooves spaced parallel to the circumferential lid opening, wherein a spacing interval of the supporting grooves is approx. 30-80 mm.

6. The suitcase according to claim 2, wherein the push-button and a push-button force-distributing strut are configured integrated in the suitcase lid and the telescopic runners are fastened to the suitcase base, wherein the push-button extends into the at least one first opening of the suitcase lid in a relaxed state and forms part of a substantially smooth, conclusive outer surface of the top side of the suitcase lid.

7. The suitcase according to claim 6, wherein the locking mechanism has a locking point in a maximum extended state and at least one locking point in a minimum inserted state, and wherein one of the telescopic runners is provided substantially in each corner of the suitcase in a top view of the suitcase lid.

8. The suitcase according to claim 1, wherein the translatory guide device is configured with a range substantially corresponding in amount to the length of the suitcase so that the length of the suitcase is substantially doubled in the expanded, open suitcase state and is configured with a trolley handle arranged on the rear wall of the suitcase, the trolley handle being movable by lockable telescopic runners, wherein the length of the suitcase in the expanded, open suitcase state substantially exceeds a maximum length of the trolley handle.

9. The suitcase according to claim 1, wherein the compartments of the flexible partition are made of textile, wherein compartment bottoms of the flexible partition are made of a reinforced material such as plastic and each bottom edge of the compartment bottoms having a stiffening and reinforcing strut in the form of a metal rod, wherein side walls of the compartments of the flexible partition are reinforced and have a height from the compartment bottom which corresponds to a compressed height substantially in the amount of the length of the suitcase in the closed state divided by the number of compartments, and wherein a flexible side wall variable in height is adjoined over three closed sides of the compartments.

10. The suitcase according to claim 1, wherein a runner for receiving objects is centrally formed on the inside of the suitcase lid, wherein the suitcase lid having a circumferential groove or a recessed lid surface on the top side.

11. The suitcase according claim 7, wherein boxes having a height such that the height of the boxes substantially corresponds to the uniformly compressed height of all compartments in the closed state of the suitcase are formed and arranged in the compartments, and the boxes are non-positively secured in the compartments in the closed state of the suitcase, and in the expanded, open suitcase state are loosely insertable and able to be pulled-out in the horizontal direction with a compartment height.

12. The suitcase according to claim 1, wherein corners of an outer surface of the suitcase base are provided with wheel housing recesses or wheel carrier posts, in one piece, and with the wheels, wherein the wheels are rotatable through 360° about axes parallel to a working direction of the translatory guide device, wherein the wheel housing recesses, on the inside of the suitcase base, have a nest with reinforcing ribs that are star-shaped to the axis of rotation arranged perpendicularly to the suitcase base.

13. The suitcase according to claim 1, wherein the suitcase lid is configured to be closable by a manually operable first closure device, the first closure device being a slide fastener or a lockable buckle fastener.

14. The suitcase according to claim 13, wherein the front lid is closed by a second closure device on the front side, the second closure being a zipper, wherein the front lid is configured to be pivotable to the rear wall, wherein the front lid on the longitudinal side of the suitcase can be swivelled to the right, wherein the lid opening is reinforced by a circumferential reinforced frame, and has a closure device, wherein a supporting strut of the translatory guide device is formed at least at the lid opening over the suitcase width on the suitcase rear wall, and also on the front wall of the suitcase.

15. The suitcase according to claim 1, wherein corners of the suitcase are rounded with a radius of curvature between 10-40 mm, wherein telescopic runners of a trolley handle are disposed substantially at the outer corners of the rear wall of the suitcase, wherein the telescopic runners of the trolley handle and the trolley handle at least partially surround an outer pocket formed on the rear wall of the suitcase, wherein the suitcase lid and the suitcase base are made of plastic and a reinforced frame, wherein the telescopic runners are made of aluminum materials and wherein lateral faces of the suitcase base, lateral faces of the suitcase lid and the front lid are made of textile materials.

16. A method for handling a suitcase according to claim 1, wherein the suitcase lid has the lifting handle recess device and the push-button is arranged on a top surface of the suitcase lid, the push-button being pressed in order to release a locking of the telescopic runners in order to transfer the suitcase into the expanded, open suitcase state or the compressed, closed suitcase state to thus open or close the suitcase.

17. A lightweight suitcase with a mobile closet function, comprising:

a suitcase base having wheels, which are mounted on the suitcase base and able to be rotated 360° perpendicular to a roller plane, a suitcase lid in the form of a cover shell, telescopic runners with integrated locking devices as prefabricated components, wherein the cover shell and the telescopic runners are configured to be locked, translatively retracted and translatively pulled out by a push-button integrated in the cover shell, an integrated push-button force-distributing strut and a supporting strut, wherein the suitcase is configured with a spatial structure that forms a closet, wherein, the suitcase comprises a flexible partition having compartments arranged parallel to the suitcase lid and parallel to the suitcase base, a height of the compartments being variable between a compressed height when the suitcase is in a compressed, closed suitcase state and an expanded height when the suitcase is in an expanded, open suitcase state, the expanded, open suitcase state being when the suitcase lid is at a maximum expanded open length, wherein the suitcase base is configured in the shape of a base pan with four circumferential lateral faces and is made as a one-piece-component, wherein the suitcase lid is configured as an outer cover shaft shell with circumferential lateral faces and is made as a one-piece-component, wherein the lateral faces of the suitcase lid have a lateral face width which comprises a lifting handle recess therein, wherein the suitcase is made out of a material mix with flexible suitcase walls made out of lightweight material that extend between the suitcase base pan made out of a hard material to be stable and the suitcase lid made out of a hard material to be stable, wherein the suitcase walls are fastened on at least three sides of the suitcase base pan, and wherein upper ends of two of the telescoping runners are attached to the integrated push-button force-distributing strut, and the integrated push-button force-distributing strut is fastened to an inside of the suitcase lid.

18. A method for producing a suitcase, the method comprising:

producing a suitcase base pan as a one-piece component, inserting a respective telescopic runner with integrated locking mechanism into each corner of the suitcase pan bottom in a form-fitting manner, inserting a push-button force distribution strut with a push-button into two of the telescopic runners with a connection to a respective locking mechanism and producing a suitcase lid as a one-piece component, inserting the suitcase lid onto ends of the telescopic runners and securing the suitcase lid to the telescopic runners in a form-fitting manner so that the push-button is substantially flush with an outer surface of the suitcase lid.

19. The method according to claim 18, wherein the suitcase lid in the form of a cover shell having at least one first opening located centrally in the region of a side edge for receiving the push-button for actuating the guide device and the suitcase lid having a lifting handle recess device which is integrated in a lateral face thereof.

20. The method according to the claim 16, wherein the suitcase lid is opened vertically to form the outer cover shell of the suitcase, wherein the suitcase has boxes in the compartments and the boxes are non-positively secured in the compartments in the horizontal direction in a translatory force-locking manner due to a weight force of the compartments and the boxes lying above them when the compartments are transferred into a compressed state and the boxes are non-positively released in the horizontal and vertical direction in a translatory force-locking manner when the compartments are expanded when the suitcase is transferred into an expanded, open suitcase state.

* * * * *